US012005289B1

(12) United States Patent
Johnson et al.

(10) Patent No.: US 12,005,289 B1
(45) Date of Patent: Jun. 11, 2024

(54) LEVER ARM SYSTEM

(71) Applicant: PRx Performance, LLC, Fargo, ND (US)

(72) Inventors: Alexander M. Johnson, Fargo, ND (US); Garrett A. Iverson, Fargo, ND (US); Jeremy K. Warzecka, Fargo, ND (US)

(73) Assignee: PRx Performance, LLC, Fargo, ND (US)

( * ) Notice: Subject to any disclaimer, the term of this patent is extended or adjusted under 35 U.S.C. 154(b) by 0 days.

(21) Appl. No.: 18/305,664

(22) Filed: Apr. 24, 2023

(51) Int. Cl.
*A63B 21/062* (2006.01)
*A63B 21/00* (2006.01)

(52) U.S. Cl.
CPC .... *A63B 21/0624* (2015.10); *A63B 21/00065* (2013.01); *A63B 21/0628* (2015.10); *A63B 21/154* (2013.01); *A63B 21/4035* (2015.10)

(58) Field of Classification Search
CPC ..... A63B 21/00065; A63B 21/0624; A63B 21/0615; A63B 21/0616; A63B 21/0617; A63B 21/0628; A63B 21/154; A63B 21/4035
See application file for complete search history.

(56) References Cited

U.S. PATENT DOCUMENTS 6,238,323 B1 * 5/2001 Simonson ..... A63B 21/0628 482/102
6,443,877 B1 * 9/2002 Hoecht ..... A63B 23/035 482/138
7,641,602 B2 * 1/2010 Rogers ..... A63B 21/08 482/135
8,287,434 B2 10/2012 Zavadsky
8,506,459 B2 8/2013 Cassidy
9,302,136 B2 4/2016 Lyszczarz
9,457,225 B2 10/2016 Lagree
10,265,572 B2 4/2019 Bach
10,335,626 B2 7/2019 Orady
10,363,473 B2 7/2019 Martens
10,486,015 B2 11/2019 Valente
(Continued)

OTHER PUBLICATIONS https://www.instagram.com/p/CUXwoUrj_Wf/?igshid=YmMyMTA2M2Y=; Instagram Post from kaizendiygym—DIY Jammer Swivel Arm Video Webpage and Screenshots Thereof; Sep. 28, 2021.

(Continued)

*Primary Examiner* — Zachary T Moore
(74) *Attorney, Agent, or Firm* — Neustel Law Offices

(57) ABSTRACT

A lever arm and method of use are disclosed herein. An example lever arm includes a translatable positioning assembly having a handle assembly having a trigger lock, the handle assembly being configured to engage with a frame member of a rack in such a way that the handle assembly can be selectively positioned along the frame member. The trigger lock is configured to engage with one of a first plurality of apertures of the frame member when a desired position for the translatable positioning assembly is selected. An armature that is pivotably coupled to the handle assembly in such a way that the armature can pivot in a first plane. The armature is configured to pivot in a second plane. The lever arm includes a first guide that is rotatably coupled to an end of the armature to allow the first guide to swivel.

21 Claims, 14 Drawing Sheets

(56) References Cited

U.S. PATENT DOCUMENTS

| | | | | |
|---|---|---|---|---|
| 10,589,163 | B2 | 3/2020 | Orady | |
| 10,617,903 | B2 | 4/2020 | Orady | |
| 10,661,112 | B2 | 5/2020 | Orady | |
| D890,271 | S | 7/2020 | Carmichael | |
| D890,867 | S | 7/2020 | Carmichael | |
| D898,136 | S | 10/2020 | Carmichael | |
| D898,137 | S | 10/2020 | Carmichael | |
| 10,792,539 | B1 | 10/2020 | Gilstrom | |
| 10,874,905 | B2 | 12/2020 | Belson | |
| 10,881,890 | B2 | 1/2021 | Orady | |
| 10,918,899 | B2 | 2/2021 | Mikhaylovich | |
| 10,987,565 | B2 | 4/2021 | Orady | |
| 11,103,738 | B2 | 8/2021 | Sorin | |
| 11,154,752 | B2 | 10/2021 | Azaria | |
| 11,173,337 | B2 * | 11/2021 | Jones | A63B 21/0615 |
| 11,517,785 | B1 * | 12/2022 | Nolan | A63B 17/04 |
| 2006/0035764 | A1 * | 2/2006 | Webber | A63B 23/1263 482/137 |
| 2007/0054785 | A1 * | 3/2007 | Drechsler | A63B 21/156 482/94 |
| 2017/0266481 | A1 | 9/2017 | Dalebout | |
| 2020/0114196 | A1 | 4/2020 | Habing | |

OTHER PUBLICATIONS https://www.instagram.com/p/CUNsbqigzF_/?igshid=YmMyMTA2M2Y=; Instagram Post from kaizendiygym—Jammer Arm Prototype Video Webpage and Screenshots Thereof; Sep. 24, 2021.

http://www.rogersathletic.com/monster-incline-arms/; Rogers Athletic Monster Incline Arms Webpage and Screenshots Thereof; Oct. 19, 2022.

https://www.instagram.com/reel/Ci7n3rCAR9P/?igshid=NDRkN2NkYzU%3D; Instagram Post from kaizendiygym—Lever Arm Adapters Video Webpage and Screenshots Thereof; Sep. 25, 2022.

https://www.crandallfitness.com/product-page/cf-adjustable-free-motion-swing-arms; Crandall Fitness "CF Adjustable Free Motion Swing Arms" Product Webpage; Feb. 24, 2023.

https://straydogstrength.com/product/alpha-arms/; Straydog Strength "Alpha Arms" Product Webpage; Feb. 24, 2023.

https://kingsbox.com/product/adjustable-jammer-arms-mighty/; KingsBox "Adjustable Jammer Arms (Mighty)" Product Webpage; Feb. 24, 2023.

https://gym-pin.co.uk/product/kaizen-jammer-arm-adapters-rogue-2-0/; GymPin "KAIZEN Jammer Arm Adapters—Rogue 2.0" Product Webpage; Feb. 24, 2023.

https://vendettastrengthandathletics.com/products/adjustable-lever-arm-rogue-adapter-brackets-pair; Vendetta Strength & Athletics "Vendetta 180° Adapters for 1" RG-M 1.0 Lever Arms (Pair)" Product Webpage; Feb. 24, 2023.

https://www.primefitnessusa.com/products/functional-trainer; Prime Fitness USA "Functional Trainer" Product Webpage; Sep. 22, 2022.

https://www.roguefitness.com/monster-lt-1-50-cal-trolley-2-0-and-lever-arm-kit; Rogue Fitness "LT-1 50 CAL Trolley and Lever Arm Kit" Product Webpage; Sep. 22, 2022.

https://www.roguefitness.com/monster-ah-1-articulating-handle-kit; Rogue Fitness "AH-1 Articulating Handle Kit" Product Webpage; Sep. 22, 2022.

https://www.roguefitness.com/monster-lt-1-50-cal-trolley-2-0-and-lever-arm-kit; Rogue Fitness "Monster Lite LT-1 50 CAL Trolley and Lever Arm Kit" Product Webpage; Sep. 22, 2022.

https://www.phenoxfitness.com/product-page/hella-fit-system; PhenoX Fitness "Hella Fit System" Product Webpage; Sep. 22, 2022.

https://www.instagram.com/p/CNxYtYGhwR_/; Phenox Fitness Instagram Post Hella Fit System Webpage and Screenshots Thereof; Apr. 17, 2021.

https://www.sorinex.com/products/jammer-arms?variant=14242900213802; Sorinex Exercise Equipment "Jammer Arms" Product Webpage; Sep. 22, 2022.

https://www.sorinex.com/products/j-squat; Sorinex Exercise Equipment "JxSquat" Product Webpage; Sep. 22, 2022.

https://www.thehenny.com/product-page/the-henny; OverAchieve Sports and Speed, LLC "The Henny Attachment (Base Kit)" Product Webpage; Sep. 22, 2022.

https://www.instagram.com/p/CXWX80jFGgm/; OverAchieve Sports and Speed Instagram Post "Henny Attachment on Instagram" and Screenshots Thereof; Dec. 11, 2021.

https://www.primalstrength.com/products/primal-strength-gls-v2-0-jammer-arms; Primal Strength "Primal Pro Series GLS Jammer Arms—V2.0"; Sep. 22, 2022.

https://www.instagram.com/p/B4Zhw4CAQ8V/?img_index=1; Gavinlairdstrength Instagram Post "GLS Jammers from @primalstrengthofficial" and Screenshots Thereof; Nov. 3, 2019.

https://www.instagram.com/p/Bxayd5LAB-x/?img_index=1; Gavinlairdstrength Instagram Post "The GLS by @primalstrength" and Screenshots Thereof; May 13, 2019.

https://www.instagram.com/p/BxYU4snAxD4/?utm_source=ig_web_copy_link; Gavinlairdstrength Instagram Post "A quick look around the GLS" and Screenshots Thereof; May 12, 2019.

https://cftperformance.com/swing-in-multi-stop-trolley-jammer-mount/; CFT Custom Fabrication "Swing in Multi Stop Trolley / Jammer Mount." Product Webpage; Sep. 22, 2022.

https://www.instagram.com/reel/Cbh_egBADL-/?img_index=1; Home_gym_journey Instagram Post "Lever Arm Full Body Workout CFT Performance 24" Lever Arms" and Screenshots Thereof; Mar. 25, 2022.

https://vendettastrengthandathletics.com/products/adjustable-lever-arm-titan-adapter-mounts-pair; Vendetta Strength & Athletics "Vendetta 180° Adapters for 3x3 Titan Lever Arms (Pair)" Product Webpage; Sep. 22, 2022.

https://www.instagram.com/reel/CbobgdSg936/?utm_source=ig_web_copy_link; Vendettastrethandathletics Instagram Post "We had Several Questions How to Trolley Works" Demo; Mar. 27, 2022.

https://www.bellsofsteel.us/product-category/racks/hydra/; Bells of Steel "Hydra Series" Webpage; Sep. 22, 2022.

https://www.bellsofsteel.us/all-products/racks/hydra/hydra-3-x-3-inch-four-post-power-rack/#choose-your-height; Bells of Steel "Hydra 3 × 3 Inch Four Post Power Rack" Product Webpage; Sep. 22, 2022.

https://www.bellsofsteel.us/all-products/racks/hydra/hydra-atachments/hydra-attachments-non-storage/hydra-sliding-lever-arms-pair/; Bells of Steel "Hydra Sliding Lever Arms—Pair"; Sep. 22, 2022.

https://www.vaseven.com/en/shop/jammer-arms/; VASEVEN "Jammer Arms (Pair)" Product Webpage; Sep. 22, 2022.

https://www.instagram.com/p/B_AVb6PgtUn/?utm_source=ig_web_copy_link; VA Seven Strength Equipment Instagram Post "De Zum Gestrigen Post" and Screenshots Thereof; Apr. 15, 2020.

https://www.instagram.com/p/BrACtlyAecd/?utm_source=ig_web_copy_link; VA Seven Strength Equipment Instagram Post "GB Looking for a Half Rack" and Screenshots Thereof; Dec. 5, 2018.

https://www.instagram.com/p/CfXOdSjl_5T/?utm_source=ig_web_copy_link; Savage Strength Equipment Instagram Post; "#360grips #varigripbar" and Screenshots Thereof; Jun. 28, 2022.

https://inspirefitness.com/product/ft2-functional-trainer/; Inspire Fitness "FT2 Functional Trainer" Product Webpage; Sep. 22, 2022.

https://www.hoistfitness.com/collections/consumer-featured-products/products/h-4400-4-stack-multi-gym; Hoist Fitness "H-4400 4 Stack Multi Gym" Product Webpage; Sep. 22, 2022.

https://www.ifit.com/equipment/strength; iFIT Two-Arm Function Trainer "Strength" Webpage; Sep. 22, 2022.

https://www.torquefitness.com/products/free-standing-f9-fold-away-functional-trainer; Torque USA "Free-Standing F9 Fold-Away Functional Trainer" Product Webpage; Sep. 22, 2022.

https://www.tonal.com/equipment/; Tonal Home Smart Gym Equipment Webpage; Sep. 22, 2022.

https://repfitness.com/products/ft-5000-2-0-functional-trainer; REP "FT-5000 2.0 Functional Trainer" Product Webpage; Sep. 22, 2022.

https://repfitness.com/products/ft-3000-compact-functional-trainer; REP "FT-3000 Compact Functional Trainer" Product Webpage; Sep. 22, 2022.

https://www.titan.fitness/strength/specialty-machines/upper-body/plate-loaded-functional-trainer/400868.html; Titan Fitness "Plate Loaded Functional Trainer" Product Webpage; Sep. 22, 2022.

(56) References Cited

OTHER PUBLICATIONS https://www.titan.fitness/strength/specialty-machines/upper-body/functional-trainer/400883.html; Titan Fitness "Functional Trainer" Product Webpage; Sep. 22, 2022.
https://www.titan.fitness/strength/specialty-machines/upper-body/nemesis-300-lb-single-stack-functional-trainer/401837.html; Titan Fitness "Nemesis 300 LB Single Stack Function Trainer" Product Webpage; Sep. 22, 2022.
https://totalrehabsolutions1.com/products/f3-freedom-trainer-double-stack?variant=406594093080&currency=USD&utm_medium=product_sync&utm_source=google&utm_content=sag_organic&utm_campaign=sag_organic; Total Rehab Solutions, LLC "HS—Freedom Trainer—Double Stack" Product Webpage; Sep. 22, 2022.
https://www.getrxd.com/2post4width-ft-bundle.html; Get RX'd "HRFT-400 Builder Half Rack with Functional Trainers" Product Webpage; Sep. 22, 2022.
https://www.getrxd.com/2post4width-ft-bundle.html; Get RX'd "HRFT-600 Builder Half Rack with Functional Trainers" Product Webpage; Sep. 22, 2022.

* cited by examiner

LEVER ARM SYSTEM

CROSS-REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to workout equipment, and more specifically but not by way of limitation, to a lever arm system that is adapted with a trigger lock for selective positioning. An example lever arm can also pivot in two planes and interface with a variety of attachments.

SUMMARY

Some of the various embodiments of the present disclosure relate to a system comprising a translatable positioning assembly comprising a handle assembly having a trigger lock, the handle assembly being configured to engage with a frame member of a rack in such a way that the handle assembly can be selectively positioned along the frame member, the trigger lock being configured to engage with one of a first plurality of apertures of the frame member when a desired position for the translatable positioning assembly is selected. The system also includes an armature that is pivotably coupled to the handle assembly in such a way that the armature can pivot in a first plane, the armature being configured to pivot in a second plane. Also, the system can include a weight post in association with the armature, the weight post configured to allow a user to attach a load to the armature.

Some of the various embodiments of the present disclosure relate to a system comprising a translatable positioning assembly comprising a handle assembly having a trigger lock, a first plate, and a second plate, the handle assembly being configured to engage with a frame member of a rack in such a way that the handle assembly can be selectively positioned along the frame member, the trigger lock being configured to engage with one of a first plurality of apertures of the frame member when a desired position for the translatable positioning assembly is selected, wherein the trigger lock is aligned with a grip of the handle assembly such that a user can grasp the trigger lock with a hand that is also used to hold the grip and moved handle assembly. The system also includes an armature that is pivotably coupled to the handle assembly in such a way that the armature can pivot in a first plane and a second plane that is orthogonal to the first plane. In some embodiments, the system includes a pivot coupling member comprising a bracket and a third plate, the bracket being coupled to the handle assembly in such a way that the bracket can pivot in the first plane, the armature being coupled to the third plate in such a way that the armature can pivot in the second plane.

In various embodiments, the system includes a first guide that is rotatably coupled to an end of the armature to allow the first guide to swivel, a second guide that is located on the armature, a third guide that is orthogonal to the second guide, and a tether that extends through each of the first guide, the second guide, and the third guide, the tether being coupled with a load.

There has thus been outlined, rather broadly, some of the embodiments of the present disclosure in order that the detailed description thereof may be better understood, and in order that the present contribution to the art may be better appreciated. There are additional embodiments that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Figure 1:
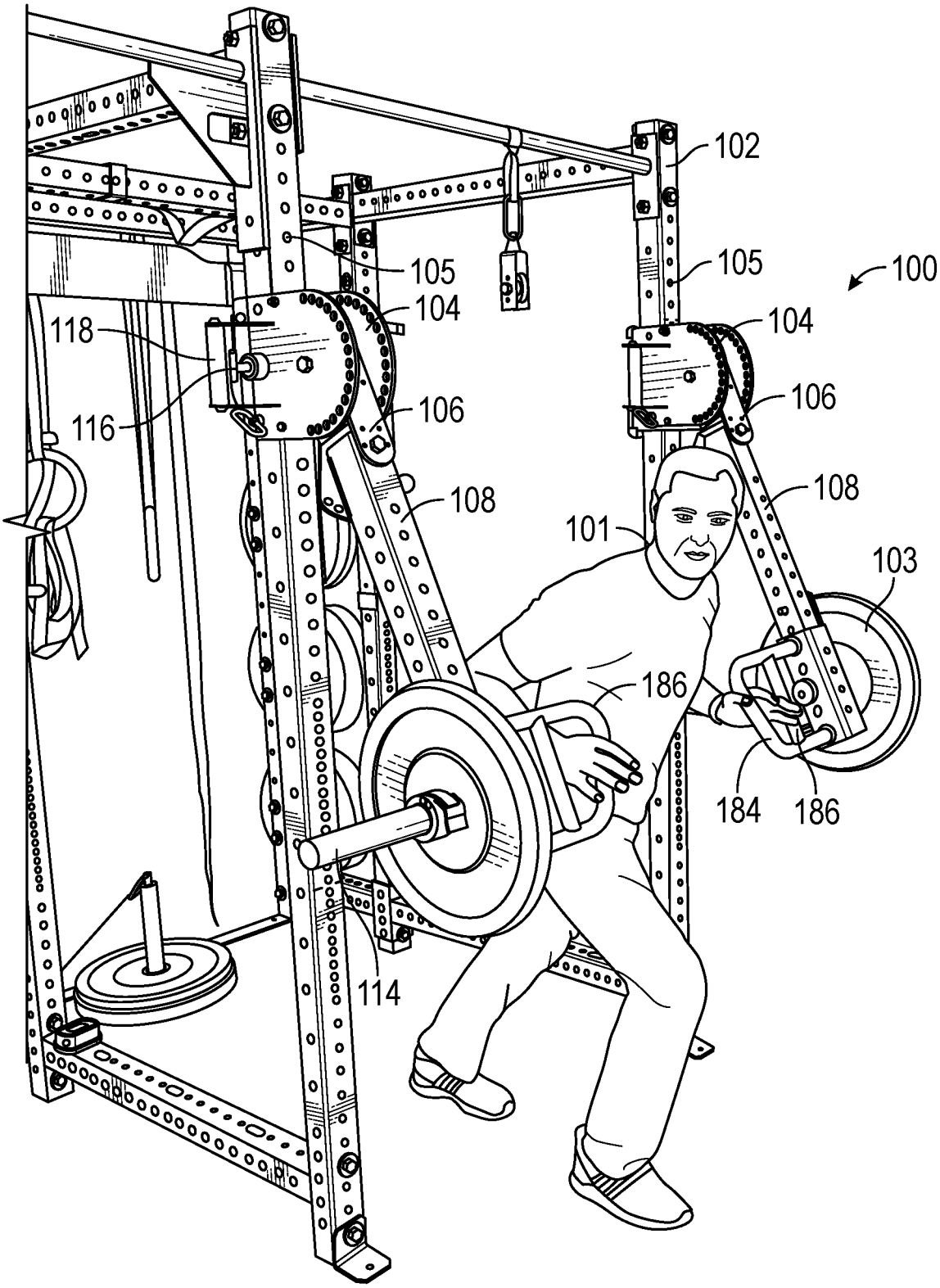
FIG. 1 is a perspective view of a system in accordance with an example embodiment.

Some of the various embodiments of the present disclosure relate to a system, such as a lever arm, that is configured to interface with a frame, such as a workout rack. The system is configured to allow a user to selectively position the system along a vertical frame member of the workout rack with a trigger lock that is incorporated into a handle assembly. The user can select the vertical position and use the trigger lock with a single hand. In some embodiments the handle and trigger lock are disposed on a side of the handle assembly.

The system also includes an armature that is pivotally coupled to the handle assembly through a pivot coupling assembly, as well as a series of guides and attachments that allow the system to be used in a variety of manners. Thus, the system is configured to not only be vertically positioned but the armature can also move in two separate pivot planes. Once a vertical position has been established, a user can select a position the armature in a first pivot plane via the pivot coupling member. In some embodiments, the pivot coupling member includes a bracket and plate.

In some embodiments, the armature is coupled to the pivot coupling member. The bracket of the pivot coupling member can be coupled to plates that are part of the handle assembly. A pin or other similar releasable fastener can be inserted through apertures in the plates of the handle assembly to lock the armature in its position or limit the armature's motion. In general, this first pivot plane is orthogonal to the frame member, and the armature can move in an arc about its pivot point connection to the handle assembly via a bracket.

Once the position in the first pivot plane is selected, the user can then select a position for the armature in the second pivot plane. As will be discussed in greater detail herein, the second pivot plane is orthogonal to the first pivot plane. The pivoting of the armature in the second plane is facilitated by a plate that is coupled to the bracket that is used to position the armature in the first pivot plane. The plate includes apertures for positioning the armature and a pin can be placed through one of these apertures to select the position of the armature in the second plane.

In one embodiment, the armature can have a weight post and multi-position handle. In some configurations, this weight post and handle are incorporated into an attachment.

In one embodiment, a tether can be used in some instances to couple with a load or weight. The tether can thread between a series of guides such as pullies. A first guide can be rotatably coupled to an end of the armature to allow the first guide to swivel. Another set of pulleys is used to guide the tether and allow for both left and right movement of the armature in the second plane. In some embodiments, yet another pulley can be used to direct the tether to the center of the armature for alignment.

In some embodiments, various attachments can be attached to the armature. The attachments can include handles or grips that can be positioned along the armature. These attachments can give a user a place for gripping or leverage.

B. Example Embodiments

Referring now to FIG. 1 which in general illustrates an embodiment of a system in the form of a lever arm 100. The lever arm 100 is generally configured to attach to a workout rack, and specifically to a frame member 102 of the workout rack. While in this embodiment the frame member is vertically oriented, the frame member can be oriented in any direction. A user 101 is employing the lever arm 100 to perform an exercise. In this example, the user 101 is using the lever arm 100 to lift a load 103 joined to a weight post 114. It will be understood that the lever arm can be used to lift a load connected through, a stack of weights without a tether, or with both a tether and weights, as will be discussed in greater detail herein.

In some embodiments, the frame member 102 is a square, tubular length of material that has four sides. Each of the sides includes holes or apertures for receiving pins that are used to hold attachments. One such attachment is the lever arm 100.

Figure 2:
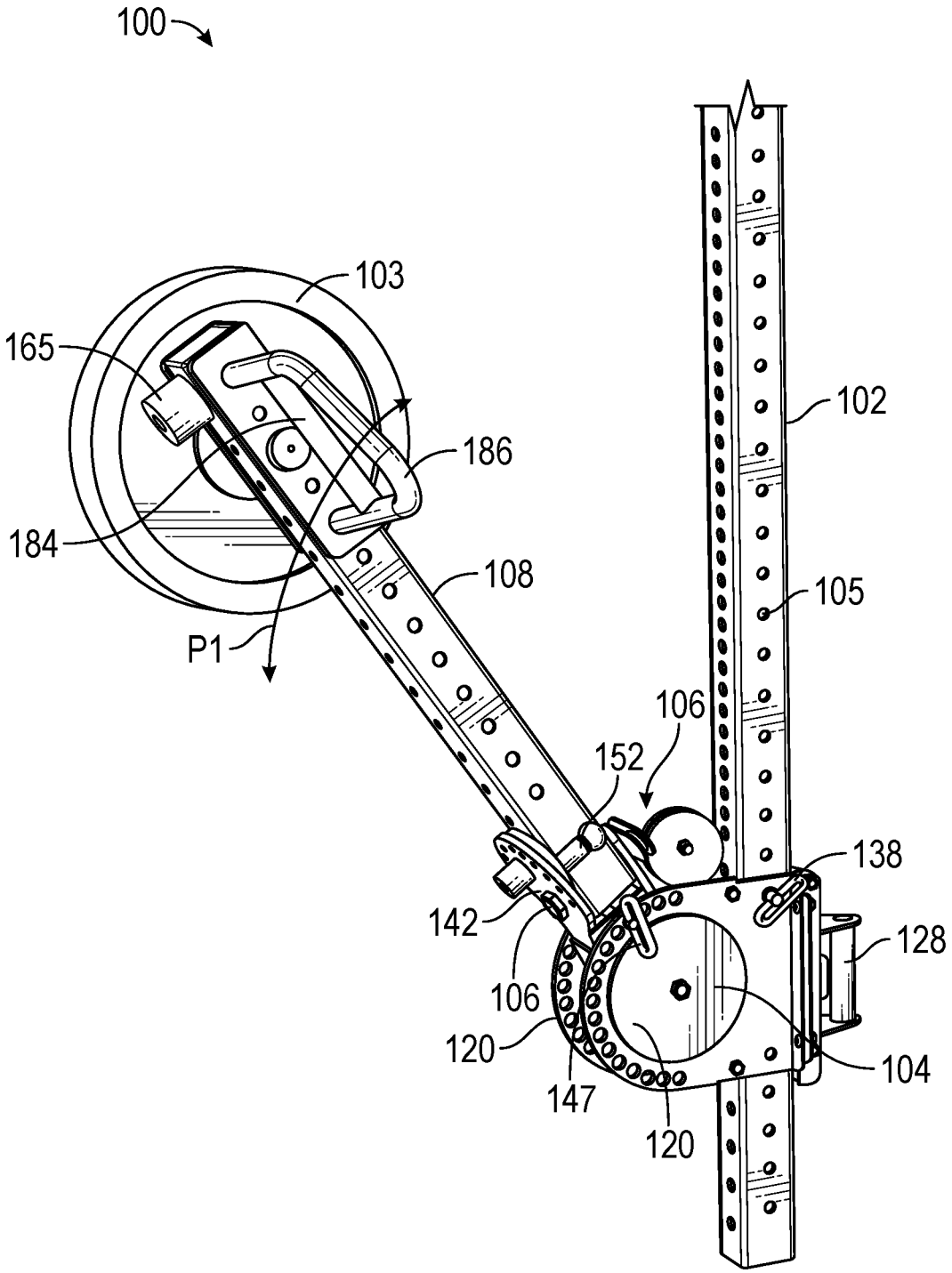
FIG. 2 is a perspective view of an example lever arm.
Figure 9:
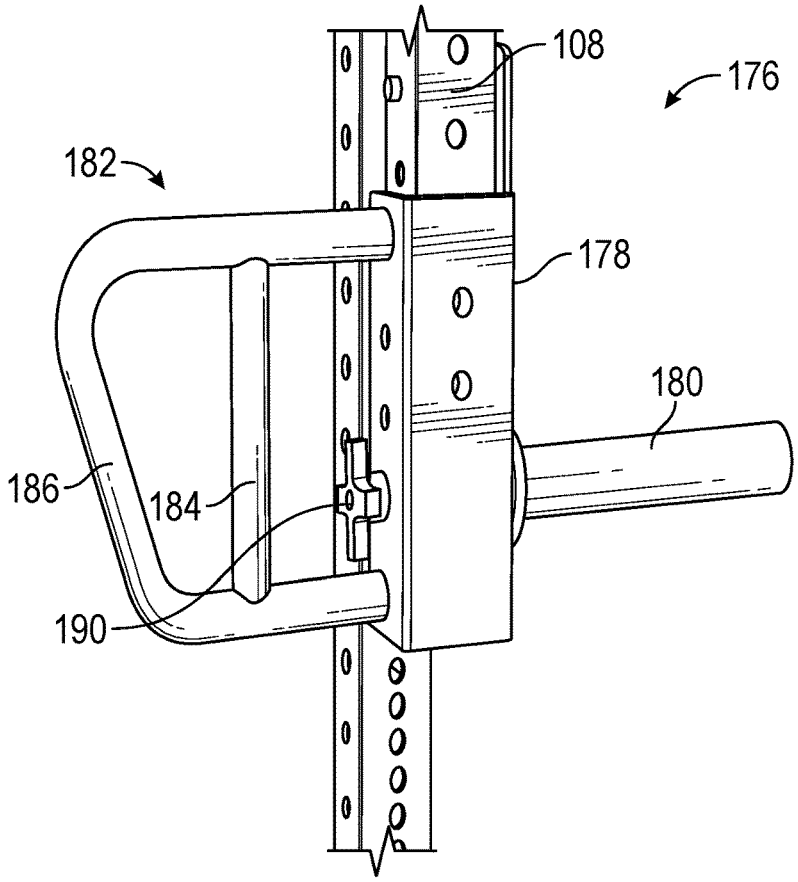
FIG. 9 is a perspective view of an example weight post of an attachment.
Figure 10:
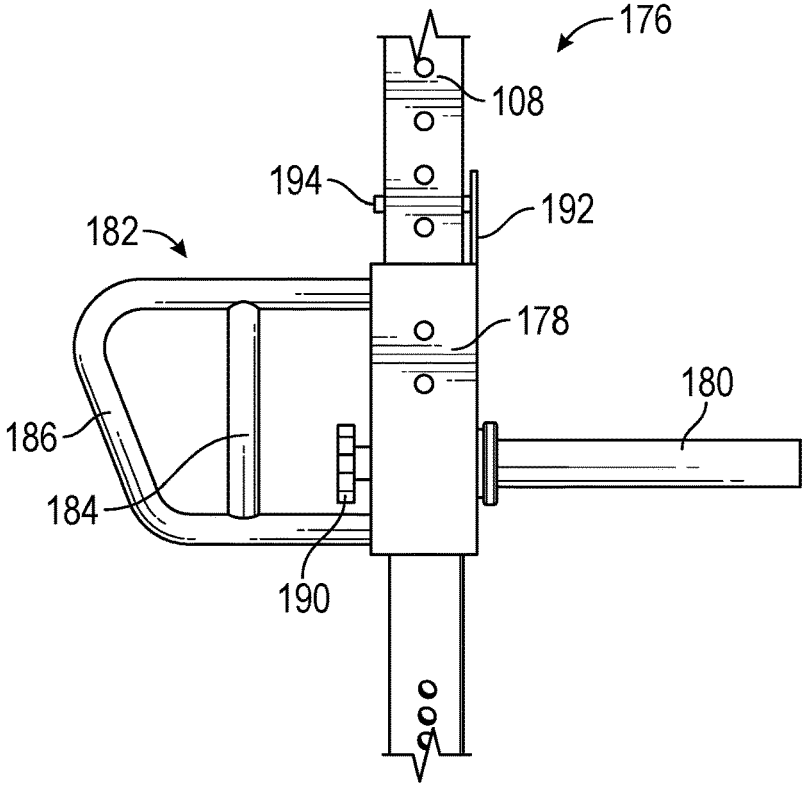
FIG. 10 is another perspective view of an example weight post of an attachment.

Referring now to FIG. 2, the lever arm 100 includes a translatable positioning assembly 104, a pivot coupling member 106, an armature 108, and optionally a weight post 114 (FIG. 1) that can be included in an attachment in some embodiments (see an example in FIGS. 9 and 10). The weight post 114 can be directly integrated into the armature 108 or can be part of an attachment.

Figure 3:
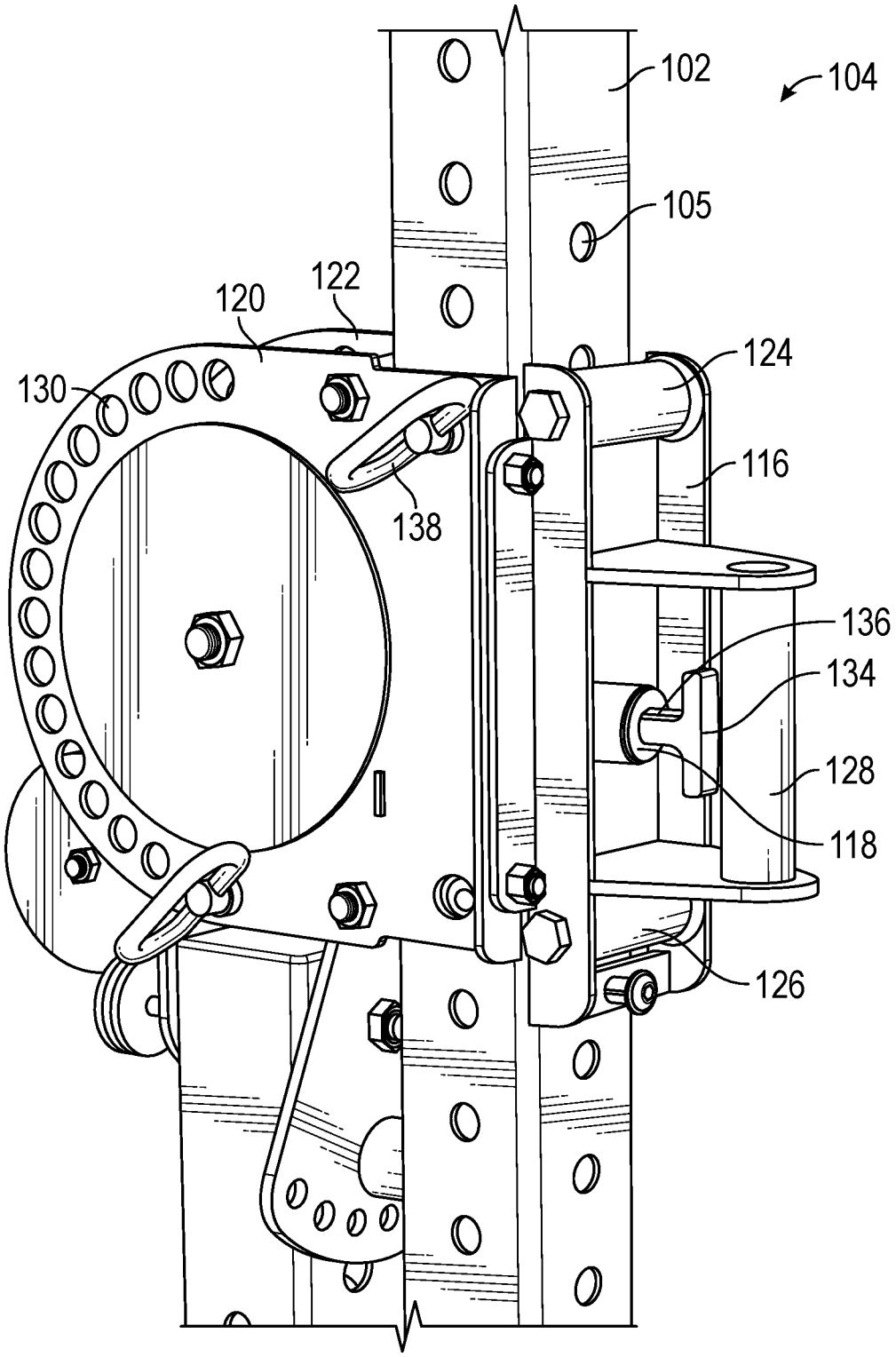
FIG. 3 is a perspective view of an example translatable positioning assembly.
Figure 4:
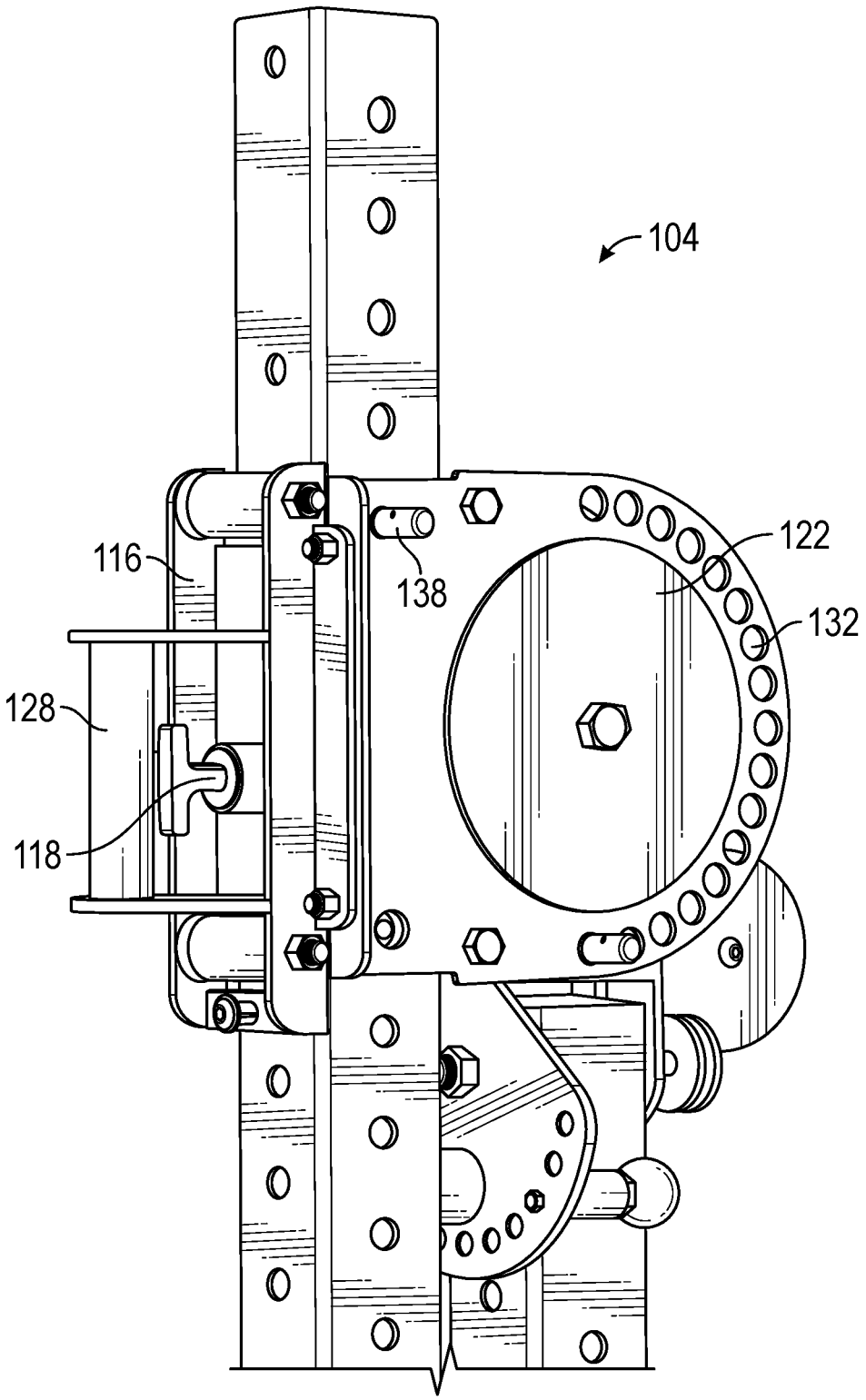
FIG. 4 is another perspective view of an example translatable positioning assembly.

In some embodiments, as illustrated in FIGS. 3 and 4 collectively, the translatable positioning assembly 104 comprises a handle assembly 116 and a trigger lock 118. In sum, the handle assembly 116 is configured to engage with a frame member of a rack in such a way that the handle assembly can be selectively positioned along the frame member. The trigger lock 118 is configured to engage with one of apertures 105 of the frame member 102 when a desired position for the translatable positioning assembly is selected. The trigger lock 118 can be alternatively replaced with a pin or other static or dynamic locking member that would be known to one of ordinary skill in the art.

There are many embodiments of the translatable positioning assembly 104 described herein, and the translatable positioning assembly 104 that can be incorporated are not limited. Example translatable positioning assemblies are illustrated in FIGS. 2-5 and 14-15.

In more detail, the handle assembly 116 generally comprises a first plate 120, a second plate 122, a first roller 124, a second roller 126, and a handle 128 (may be referred to as a grip). The first and second plates 120 and 122 are spaced apart from one another to fit around the frame member 102. In some embodiments, the first plate 120 comprises a first row of apertures 130 and the second plate 122 comprises a second row of apertures 132. In some embodiments, both the first and second row of apertures 130 and 132 are arranged in an arcuate pattern. The first and second row of apertures 130 and 132 align with one another to receive a securement member, such as a pin, as will be discussed herein.

Figure 6:
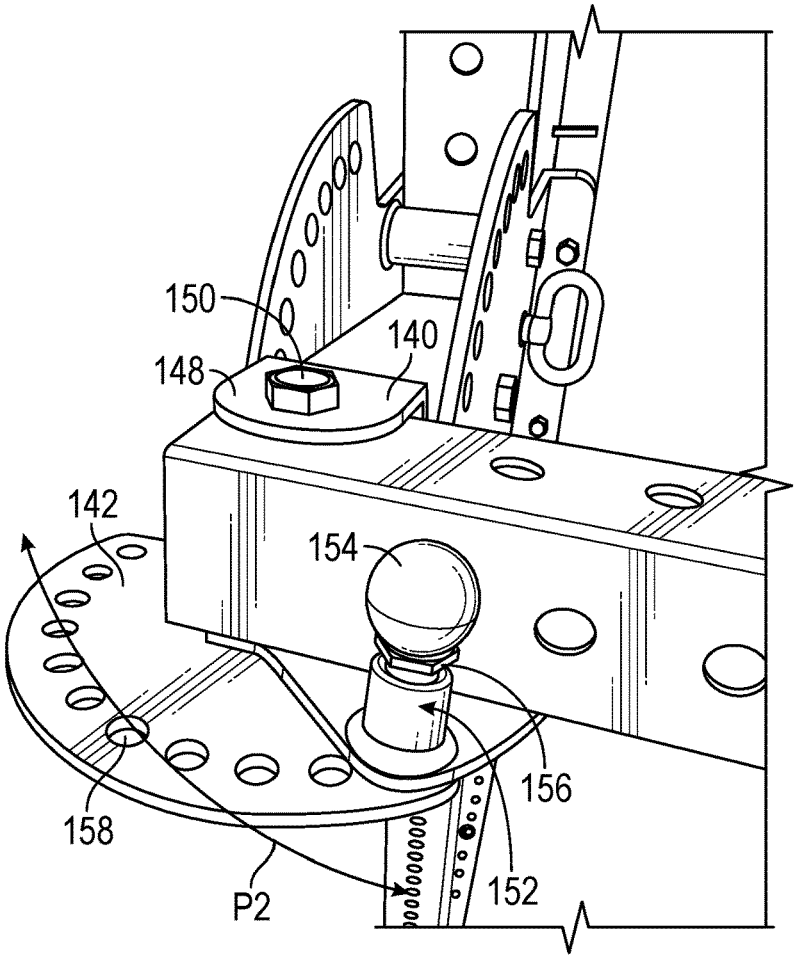
FIG. 6 is a top-down perspective view of the pivot coupling member.
Figure 7:
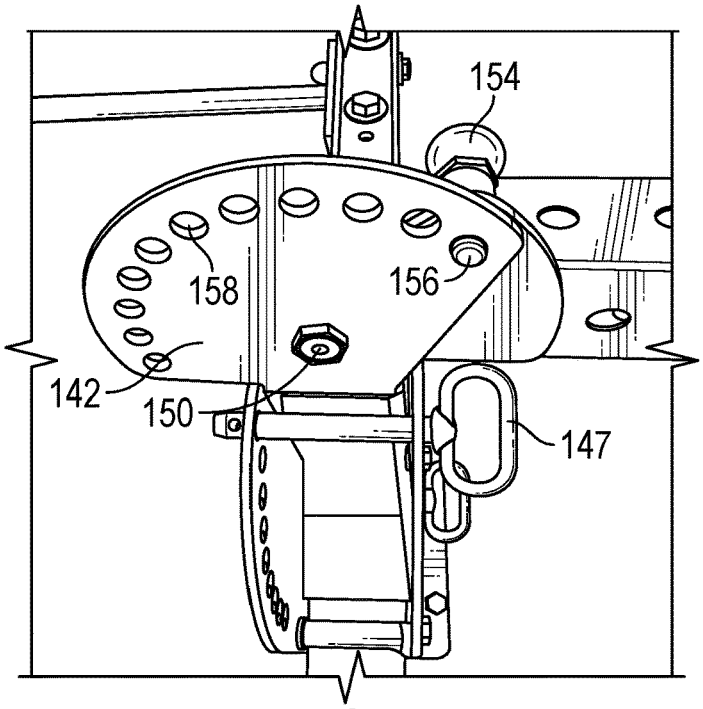
FIG. 7 is a bottom-up perspective view of the pivot coupling member.

The first and second rollers allow for fluid translation of the handle assembly 116 by the user. It will be understood that although not shown, there are two more rollers on an opposing side of the handle assembly 116 in between the first plate 120 and the second plate 122, as shown in FIGS. 6 and 7. These four rollers cooperate to surround the frame member 102. While four rollers have been disclosed, fewer or more rollers can be used.

The handle 128 is adapted to allow a user to grip and translate the handle assembly 116 along the frame. The trigger lock 118 includes a T-shaped grip 134 that is coupled with a shaft 136 that is resiliently biased by a spring or other similar member. The shaft 136 is configured to engage with one of the apertures of the frame member 102 to secure the handle assembly 116 in position. When the user pulls on the T-shaped grip 134, the shaft 136 retracts or is moved towards the handle 128, disengaging the shaft 136 from one of apertures of the frame member 102 and allowing the handle assembly 116 to be translated along the frame 102 by the user.

The orientation of the trigger lock 118 is such that the T-shaped grip 134 can be grasped by the same hand the user uses to grab the handle 128 and translate the handle assembly 116 along the frame member 102. In some embodiments, the T-shaped grip 134 is aligned in parallel with the handle 128. When the user has located a desired vertical position for the handle assembly 116, the user releases the trigger lock 118. The shaft 136 of the trigger lock 118 will insert into the nearest aperture on the frame member 102 that aligns with the shaft 136. In some instances, the handle assembly 116 is slightly moved by the user until the shaft seats in an aperture of the frame member.

Once the handle assembly 116 is initially locked into place by the trigger lock 118, the user can place a first pin 138 through the first and second plates 120 and 122 and also through apertures on the frame member 102. It will be understood that the various pins, bolts, or other fastening members disclosed herein, whether fixed or removable, may generally be referred to as a locking member.

As noted above, the frame member 102 has apertures on each side. The trigger lock extends into an aperture on one side of the frame member 102 and the first pin 138 passes through apertures on the other sides of the frame member 102. In some instances, the first pin 138 and the trigger lock 118 extend orthogonally to one another. It will be understood that the trigger lock 118 may or may not extend through the frame member 102 but the first pin 138 may extend through two sides of the frame member 102 for enhanced stability. In this way, the trigger lock 118 acts as a fast means for selecting the vertical position while the first pin 138 acts as a secondary securement member. Stated otherwise, the first pin (an example locking member) secures the handle assembly to the frame member in a direction that is perpendicular to the trigger lock. The first pin is inserted into one of a second plurality of apertures of the frame member.

Referring back to FIG. 2, in some instances, the armature 108 can include an elongated, tubular member that is square in shape. The armature 108 can be created from the same stock material that is used to create the frame member 102. Thus, the armature 108 can have apertures that extend in a linear pattern along each of the four sides of the armature 108, while in alternative embodiments less than all sides can include apertures. The apertures provide a means for securing attachments to the armature 108.

Figure 5:
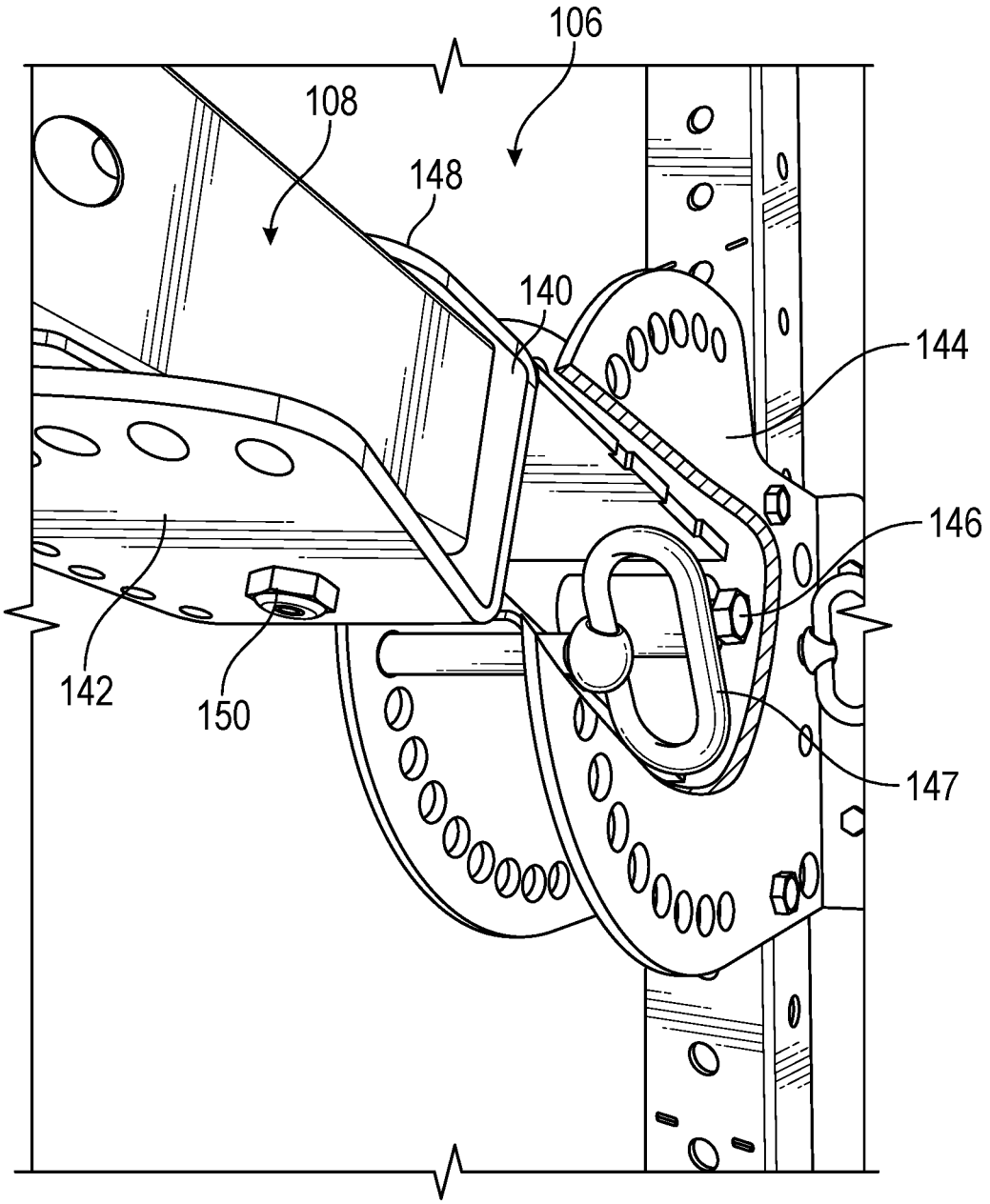
FIG. 5 is a perspective view of an example pivot coupling member.

The armature 108 is coupled to the handle assembly 116 by the pivot coupling member 106. The pivot coupling member 106 allows the armature 108 to pivot in two planes, P1 and P2 (see FIGS. 5-7). Referring now to FIGS. 5-7 collectively, the pivot coupling member 106 includes a bracket 140 and a third plate 142. The bracket 140 includes a tubular connector 144 that can be associated with the first and second plates 120 and 122 approximately at a center point. This connection allows the bracket 140 to pivot in the first plane P1. In some instances, a fastener such as a bolt 146 is used to join the pivot coupling member 106 (and specifically the tubular connector 144) to the handle assembly 116.

When the user has selected a position for the pivot coupling member 106 and the armature 108 in the first plane P1, the user can insert a second pin 147 through the first row of apertures 130 of the first plate 120 and the second row of apertures 132 of the second plate 122. In some embodiments, the second pin 147 acts as a stop where the pivot coupling member 106 can rest against the second pin 147. This allows the armature 108 to be lifted up while limiting the motion of the armature 108 in the first plane P1.

Figure 8:
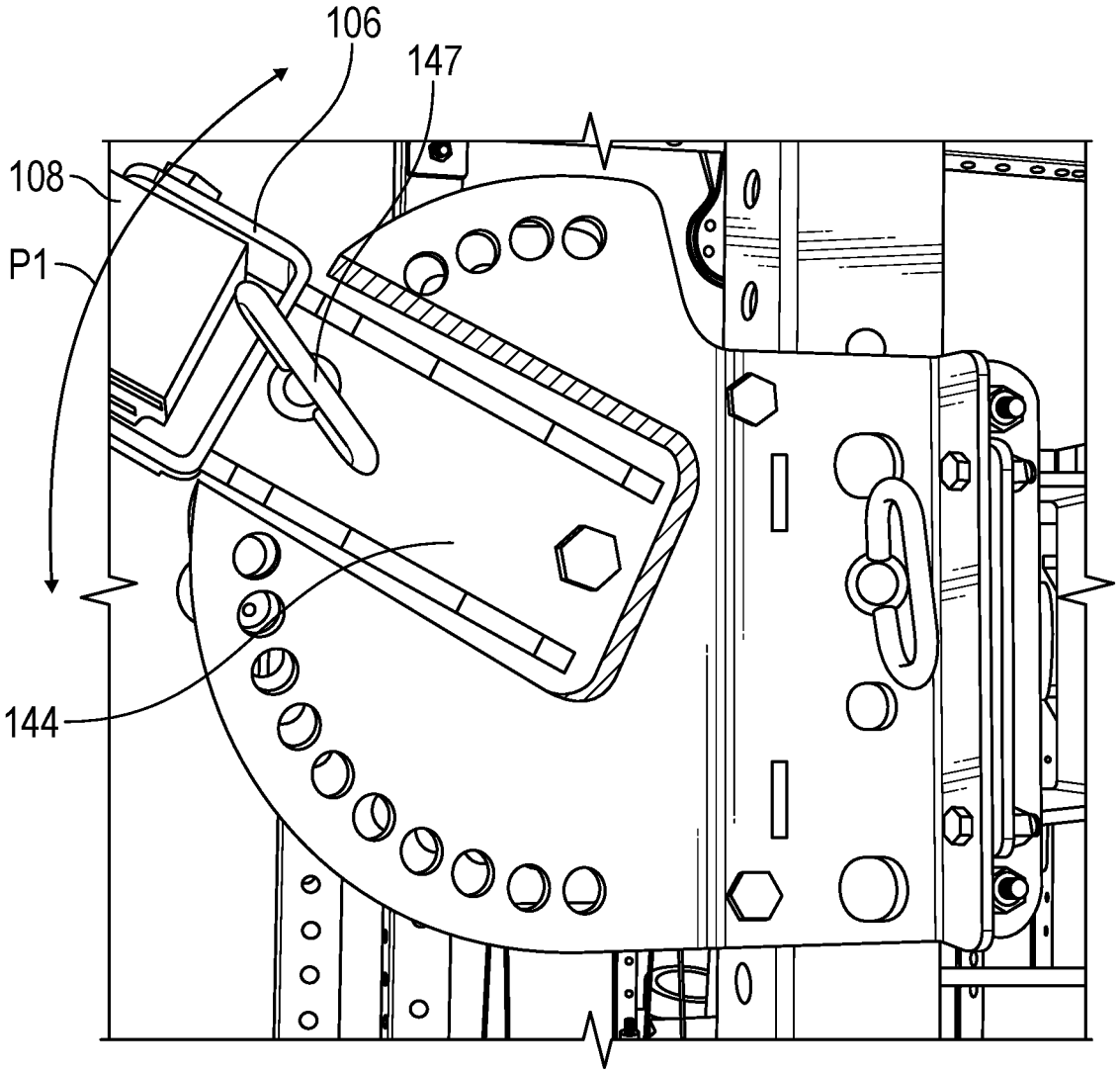
FIG. 8 is a cut away view of the pivot coupling member and translatable positioning assembly.

In another embodiment, as shown in FIG. 8, the second pin 147 can also be inserted through the pivot coupling member 106, and specifically the tubular connector 144, thereby locking the armature 108 in place. The user can lock the armature 108 or limit its motion in the first plane P1 based on an intended use for the lever arm.

Extending from the tubular connector 144 is the bracket 140. The bracket 140 is, in some embodiments, a U-shaped member that receives the armature 108. The bracket 140 includes an upper portion 148 that transitions to the third plate 142. Another bolt 150 is placed through the bracket 140 and the armature 108 to associate the armature 108 with the bracket 140. This connection allows the armature 108 to move in the second plane P2.

Referring back to FIGS. 6 and 7, a second trigger lock 152 with a round handle 154 and shaft 156 (could be spring loaded or otherwise biased) is used to select a position of the armature in the second plane P2. That is, the third plate 142 includes a third row of apertures 158 that are also arranged in an arcuate pattern around the third plate 142. To move the armature 108, a user can grab the second trigger lock 152, which disengages the shaft 156 from one of the third row of apertures 158. The armature is moved by the user in an arcuate manner in the second plane P2. The user can select the position for the armature 108 and release the second trigger lock 152 allowing the shaft 156 to seat in the nearest aperture of the third row of apertures 158. This causes the armature to lock in place in the second plane P2. It will be understood that the shaft 156 can remain in a retracted position until released by the user (or in some cases it can be locked in a retracted configuration). This allows the armature to freely pivot in the second plane until a desired position has been achieved. To be sure, the first and second trigger locks can both be locked in a retracted position.

An example armature adapter 176 is illustrated in FIGS. 9 and 10. The example armature adapter 176 includes a body 178, a weight post 180, and an ergonomic grip 182. The body 178 is configured to wrap around and overlap the armature 108 and includes apertures that can be aligned with the apertures of the armature 108 by the user. The body 178 can be connected to the armature 108 with a pin or bolt, but in some instances, the body 178 is connected by putting a threaded extension of the weight post 180 through apertures of the body 178 and apertures of the armature 108. In some embodiments, the body 178 includes an extension tab 192 and bar 194. To install the adapter 176, the bar 194 is inserted through the apertures of the armature 108. The body 178 can then pivot about the bar 194 and overlap the armature 108.

The user can secure the weight post by threading a nut 190 onto threaded extension (not shown) of the weight post 180 that extends through the armature 108. The weight post 180 can be installed laterally as shown, or the weight post 180 can be installed in a vertical, or upright configuration. It will be understood that in embodiments where the weight bar is used, the use of the tether is optional. That is, the load which is normally attached to the tether can be loaded onto the weight bar. Of course, the weight bar can be used in combination with the tether to add additional load.

The ergonomic grip 182 (also referred to as a second handle member) can be placed on an opposing side of the body 178 from the weight post 180. The second handle member extends from the armature adapter in such a way that the second handle member is positioned laterally to the armature. In some embodiments, the second handle member comprises both a straight grip 184 and an angled grip 186.

In some embodiments, the angled grip 186 defines the outer periphery of the ergonomic grip 182 and the straight grip 184 extends vertically, and inside the angled grip 186.

The ergonomic grip 182 gives the user a plurality of ways to grip and apply leverage to the armature 108.

Figure 11:
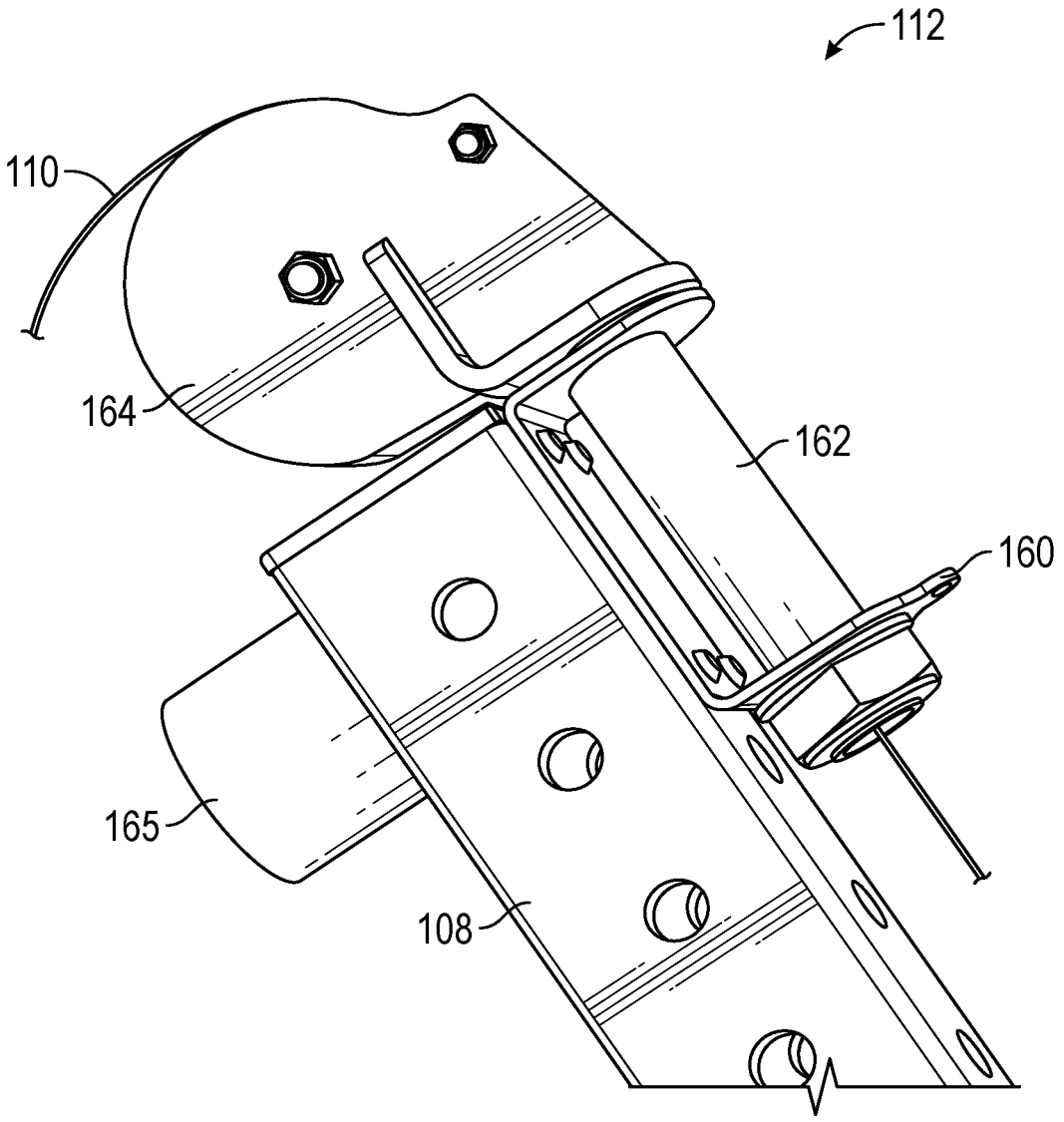
FIG. 11 is a perspective view of an armature and a swivel guide.

Referring now to FIG. 11, in some embodiments, the swiveling guide 112 is disposed on a terminal end of the armature. The swiveling guide can be mounted to an upper surface of the armature 108. The swiveling guide 112 comprises a guide bracket 160, a guide shaft 162, and a pulley 164. The guide bracket 160 is configured to attach both the guide shaft 162 and pulley 164 to the armature 108. In some embodiments, the guide bracket 160 is used to hold or space the guide shaft 162 at a distance from the upper surface of the armature 108. In some configurations, the guide bracket is an elongated member that includes armatures. The guide shaft 162 is supported on the ends of the guide bracket and the pulley 164 can freely swivel at its connection to the guide shaft 162. The pulley 164 can swivel based on the direction of a tether that can be attached thereto, as will be discussed in greater detail herein. A stop or bumper 165 can be placed on the underside of the armature 108 to prevent the armature 108 from directly contacting the frame member.

Figure 12:
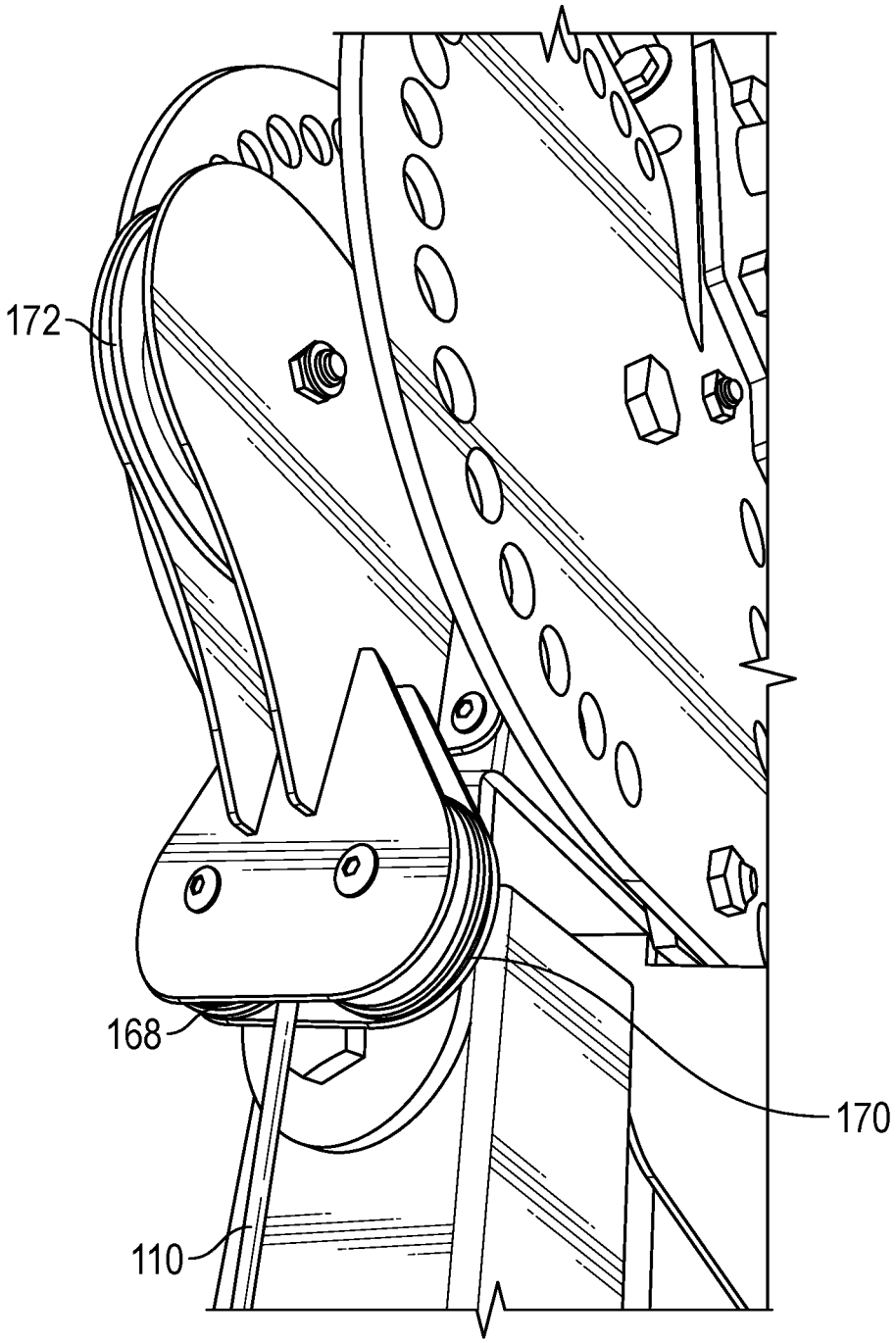
FIG. 12 is a perspective view of various pulley guides in association with the pivot coupling member.
Figure 13:
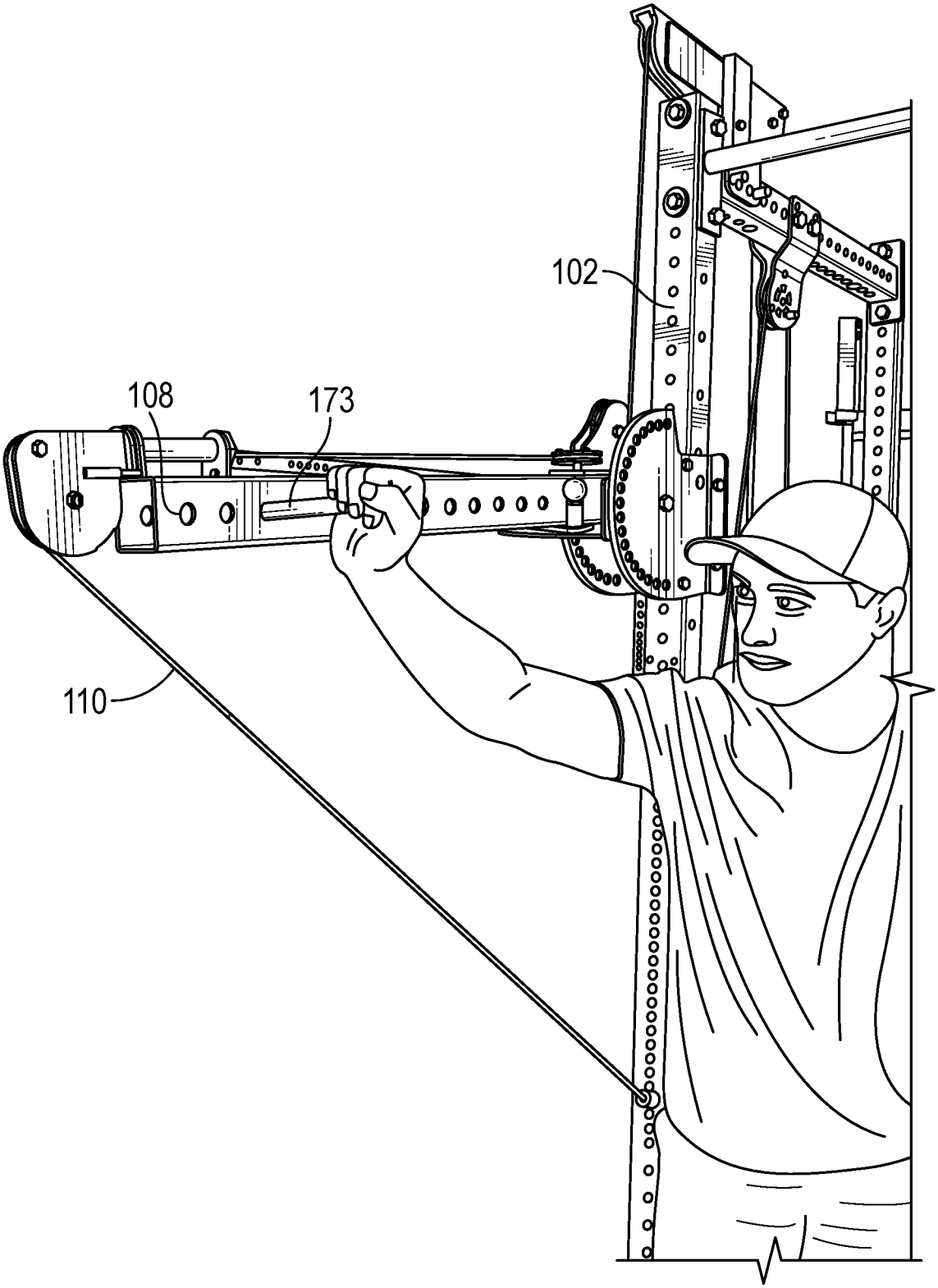
FIG. 13 illustrates a user using a lever arm with a tether attachment.

Referring to FIG. 12-13, the tether 110 can be attached at a first end to a load and at a second end to the frame. The tether 110 could be associated with any suitable type of attachment. In some embodiments, the tether 110 could be attached, via a carabiner or other device directly to the frame member 102. Regardless of the attachment type, the goal is to allow the user to move the load 103 through movement of the armature 108.

In some embodiments, the tether 110 is directed through a series of guides starting initially with the swiveling guide 112. The tether 110 can wrap around the pulley 164 and through the guide shaft 162. As shown in FIG. 12, the tether 110 then extends through two laterally disposed pulleys 168 and 170 with are coplanar with an upper surface of the armature and allow for movement of the tether 110 to the right or left (e.g., in the second plane P2). The tether then can extend around a vertically oriented pulley 172 and the tether 110 may ultimately connect to the load 103. The tether 110 can connect directly to the load or indirectly through various apparatuses or guides mounted to the frame member 102. Any number of direct or indirect connecting means can be used to couple the tether to the load, and the present disclosure should not be limited to the type of attachment means used.

According to some embodiments, a user can attach various types of attachments such as an armature adapter. Although in some instances, an attachment could be as simple as a rod 173 that is associated with the armature 108 as in FIG. 13. In this embodiment, the tether 110 is coupled to the frame member 102 and the user can lift the armature 108 with a rod that is inserted through apertures of the armature 108. The tether 110 can be attached to the frame member 102 via, for example, a pin. The rod 173 can have a plate or stop on one end that prevents the rod 173 from disassociating with the armature 108. The rod 173 is inserted through apertures of the armature 108 and is limited from passing completely through the armature 108 by the plate.

Figure 14:
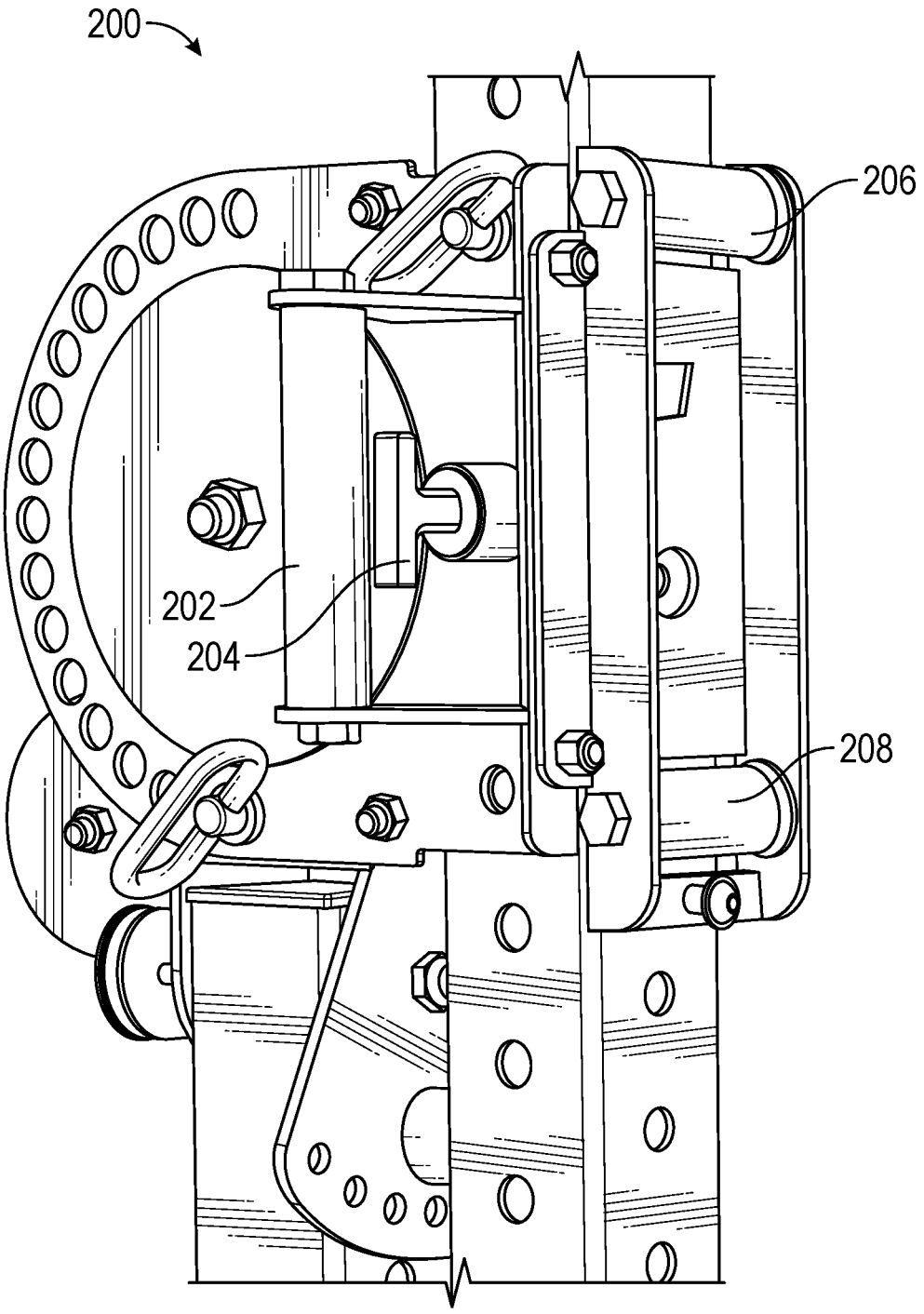
FIG. 14 is a perspective view of another example translatable positioning assembly.

FIG. 14 illustrates another example translatable positioning assembly 200. This translatable positioning assembly 200 is similar to the translatable positioning assembly 104 of FIG. 1, with the notable exception that a handle or grip 202 and trigger lock 204 are positioned laterally, rather than on the same side as the upper and lower rollers 206 and 208. In FIG. 1, the translatable positioning assembly 104 has a handle 128 and trigger lock 118 that is aligned with a first and second (e.g., upper and lower) rollers 124 and 126. In this embodiment, the grip 202 and trigger lock 204 are offset approximately 90 degrees (e.g., orthogonal) from the upper and lower rollers 206 and 208 as well as the first and second plates.

Figure 15:
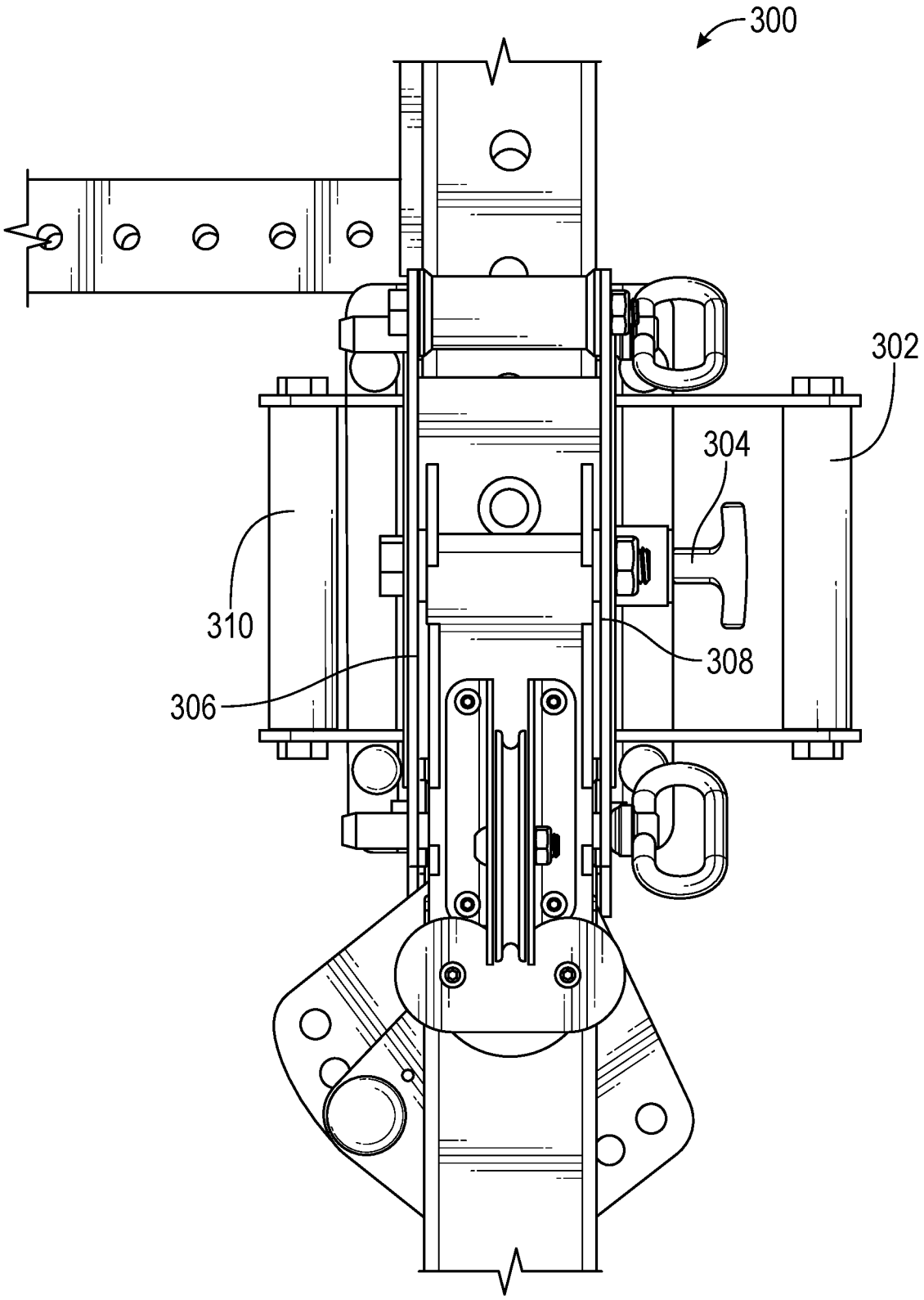
FIG. 15 is a perspective view of yet another example translatable positioning assembly.

Referring now to FIG. 15, which illustrates another example translatable positioning assembly 300. As with the embodiment of FIG. 14, the example translatable positioning assembly 300 of FIG. 15 has a handle 302 and trigger lock 304 that are disposed orthogonally to both a first and second plates 306 and 308. The example translatable positioning assembly 300 also includes a second lateral grip 310. The user can use either or both the handle 302 and second lateral grip 310 to vertically position the lever arm.

Figure 16:
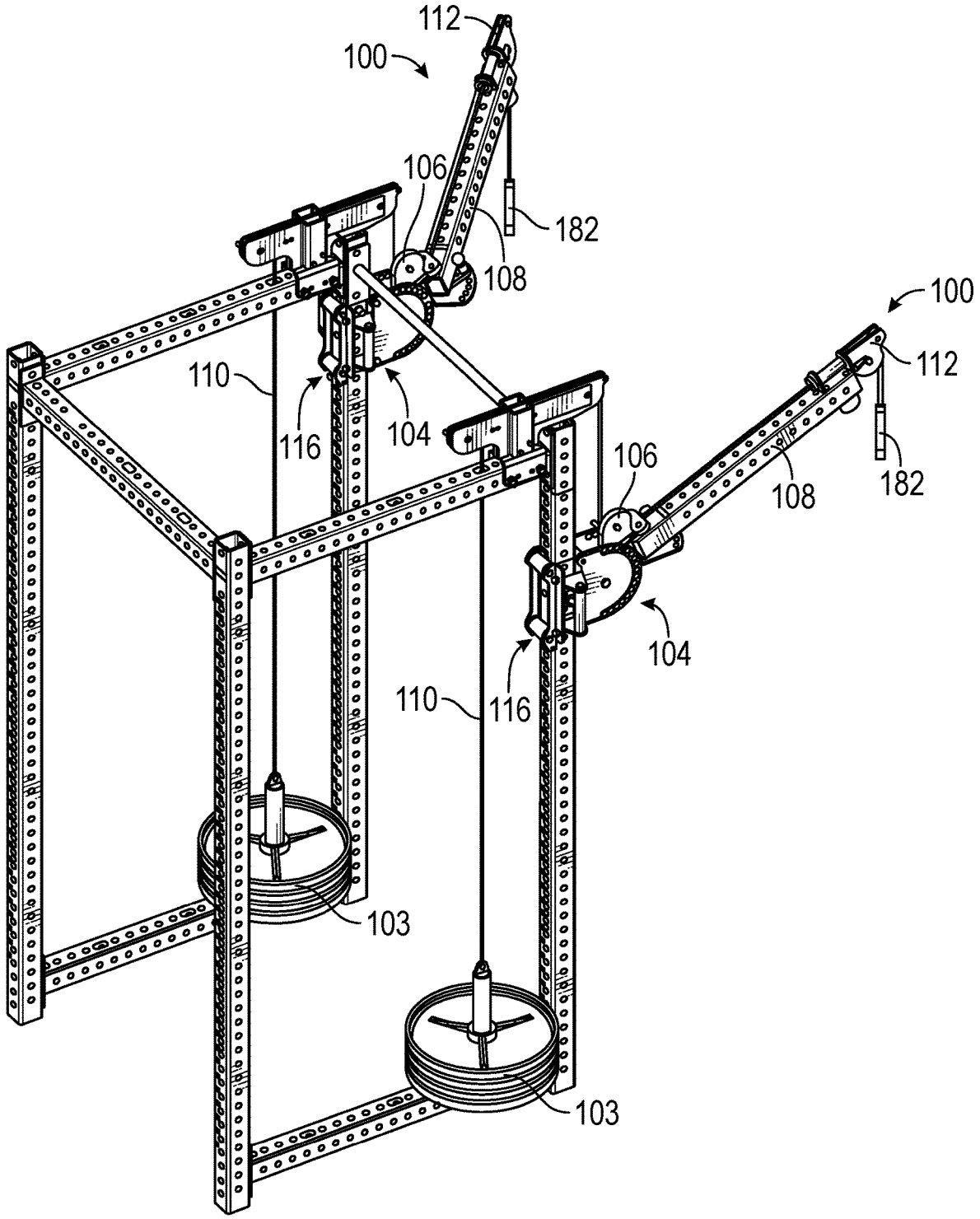
FIG. 16 is a perspective view of another example embodiment.

FIG. 16 is another example embodiment, where the tether 110 is used in combination with a lever arm 100 and a handle to provide a cable pulley workout system. The tether is connected to weights/load 103 in this example, but could also be connected to a stack of weights that are selectable by a pin (not shown). The tether 110 can also be connected to an attachment, such as a triangular handle 182.

C. Example Operation

In operation and with reference to the collective drawings, the user can attach an adapter to the armature that can include a weight post 180. This can include instances where the user desires to use weights rather than (or in addition to) a tether. In embodiments where a tether is used, the tether is attached to a load and then to the frame or another fixed anchoring point. The tether is placed through a series of pulleys that are arranged on the tether arm.

To be sure, the lever arm can be used with weights alone, with a tether and load alone, or in instances where weights and a tether/load are used in combination. Various adapters can be employed by the user that act as a grip or handle that allow the user to move the armature of the lever arm. An armature adapter could be as simple as a bar, a multi-position handle, a grip, a strap, a bar, or any other device that can be gripped by the user.

Once an adapter has been secured to the armature, the user can select a vertical position for the lever arm by grabbing the handle assembly 116. In one embodiment, the user grabs the handle 128 and the trigger lock 118 with one hand. The trigger lock disengages from the frame member 102 allowing the user to translate the handle assembly vertically (up or down). Once a desired vertical position has been achieved, the user can release the trigger lock 118 to select the vertical position. The trigger lock engages with an aperture of the frame member 102 to initially lock the lever arm 100 in position. The user can place a pin through the handle assembly and frame member in a position that is orthogonal to the trigger lock to further secure the lever arm 100 in position.

Once secured, and depending on the type of workout, the user can select a position, either free pivoting or limited, for the armature. In one example, the user can place a pin through the apertures of the first and second brackets of the handle assembly. When the pin is not inserted through the armature 108, the pin acts as a stop and the armature can rest against the pin. This configuration limits the movement of the armature in the first plane P1. When the pin is inserted through the first and second plates, along with the armature, the pin locks the armature 108 in place in the first plane P1.

Once a desired orientation in the first plane has been achieved, the user can select a position for the armature 108 in the second plane P2. The user can disengage a second trigger lock 152 which allows the armature 108 to pivot in the second plane P2. Once a desired position for the armature in the second plane P2 is found, the user releases the second trigger lock 152 and the second trigger lock 152 engages with an aperture on a third plate. To be sure, the armature 108 pivots above the third plate 142 in the second plane P2.

Once a user has selected the position of the armature in the second plane P2, the user can begin to exercise using the lever arm 100. In sum, the lever arm 100 can be selectable in its vertical position, a first plane, and a second plane. This allows a user to put the lever arm in various unique positions depending on a desired workout.

The lever arm 100 can be used with or without a tether, and with or without a weight post (when a tether is used). In instances where a tether is used, the tether is guided through a series of pulleys to ensure smooth and fluid movement of the lever arm. A swiveling guide can be included on an end of the armature which allows the user to perform movements that are lateral to the armature. This gives the user a greater range of motion for the lever arm.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term may be occasionally interchangeably used with its non-hyphenated version, a capitalized entry may be interchangeably used with its non-capitalized version, a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The terms "coupled," "connected", "connecting," "mechanically connected," etc., are used interchangeably herein to generally refer to the condition of being mechanically/physically connected. The terms "couple" and "coupling" are also used in a non-mechanical/physical context.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

The terminology used herein can imply direct or indirect, full or partial, temporary or permanent, immediate or delayed, synchronous or asynchronous, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three-dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

What is claimed is:

1. An exercise system comprising:

a translatable positioning assembly comprising a handle assembly having a trigger lock, the handle assembly being configured to engage with a frame member of a rack in such a way that the handle assembly can be selectively positioned along the frame member, the trigger lock being configured to engage with at least one aperture of a first plurality of apertures of the frame member when a desired position for the translatable positioning assembly is selected;

an armature that is pivotably coupled to the handle assembly in such a way that the armature can pivot in a first plane, the armature being configured to pivot in a second plane; and a weight post secured to an armature adapter by a connector, wherein the connector additionally engages at least one aperture of a plurality of apertures of the armature, the armature adapter being selectively positionable along the armature, the weight post configured to allow a user to attach a first load to the armature;

wherein the armature adapter includes a plurality of apertures and wherein the connector engages at least one aperture of the plurality of the apertures of the armature adapter to secure the weight post to the armature adapter, the weight post being selectively positionable along the armature adapter.

2. The exercise system according to claim 1, further comprising a tether that is coupled at a first end of the tether to a second load and at a second end of the tether to an attachment.

3. The exercise system according to claim 1, further comprising a second locking member that secures the handle assembly to the frame member in a direction that is perpendicular to the trigger lock, the second locking member being inserted into one aperture of a second plurality of apertures of the frame member.

4. The exercise system according to claim 1, wherein the handle assembly comprises:

a first plate;

a second plate; and a handle, the first plate and the second plate being spaced apart from one another so as to fit around the frame member.

5. The exercise system according to claim 4, further comprising a second locking member that is inserted through the first plate, the second plate, and the frame member.

6. The exercise system according to claim 5, further comprising a pivot coupling member comprising a bracket and a third plate, the bracket being coupled to the first plate and the second plate in such a way that the bracket can pivot in the first plane, the pivot coupling member connected to the armature.

7. The exercise system according to claim 6, wherein the third plate comprises a first arcuate row of apertures and a second lock, a position of the armature in the second plane being selected by placing the second lock into at least one aperture of the first arcuate row of apertures, the second lock being configured to lock in a retracted position to allow the armature to freely pivot in the second plane.

8. The exercise system according to claim 7, wherein the first plate comprises a second row of apertures and the second plate comprise a third row of apertures.

9. The exercise system according to claim 8, further comprising a third locking member that is placed through at least one aperture of the second row of apertures of the first plate and at least one aperture of the third row of apertures to select a position of the pivot coupling member in the first plane, the third locking member acting as a stop that the pivot coupling member rests upon.

10. The exercise system according to claim 9, further comprising a second guide that is coplanar with an upper surface of the armature and a third guide that is orthogonal to the second guide, wherein a tether is configured to engage with the second guide and the third guide.

11. The exercise system according to claim 1, wherein the trigger lock is aligned with a grip of the handle assembly such that a user can grasp the trigger lock with a hand that is also used to hold the grip and moved handle assembly.

12. The exercise system according to claim 1, wherein a first guide comprises a tubular member and a pulley, the pulley being connected to the tubular member in such a way that the pulley can swivel, the tubular member providing a pathway for a tether that is coupled to the first load.

13. The exercise system according to claim 1, further comprising a second handle member that is secured to the armature adapter.

14. The exercise system according to claim 13, wherein the second handle member extends from the armature adapter so that the second handle member is positioned laterally to the armature, the second handle member comprising both a straight grip and an angled grip.

15. The exercise system according to claim 1, wherein the armature adapter includes a bracket that is adapted to overlap and cover at least three sides of the armature, further wherein the weight post can receive and retain a weight.

16. The exercise system according to claim 1, wherein the translatable positioning assembly comprises rollers that engage with the frame member.

17. An exercise system comprising:

a translatable positioning assembly comprising a handle assembly having a trigger lock, a first plate, and a second plate, the handle assembly being configured to engage with a frame member of a rack in such a way that the handle assembly can be selectively positioned along the frame member, the trigger lock being configured to engage with at least one aperture of a first plurality of apertures of the frame member when a desired position for the translatable positioning assembly is selected, wherein the trigger lock is aligned with a grip of the handle assembly such that a user can grasp the trigger lock with a hand that is also used to hold the grip and moved handle assembly;

an armature that is pivotably coupled to the handle assembly in such a way that the armature can pivot in a first plane and a second plane that is orthogonal to the first plane;

a pivot coupling member comprising a bracket and a third plate with both the bracket and third plate being positioned forward of the first and second plates of the handle assembly, the bracket being supported by a connector that is pivotally coupled between the first plate of the handle assembly and the second plate of the handle assembly in such a way that the bracket can pivot in the first plane, the armature being pivotally coupled between an upper portion of the bracket and the third plate in such a way that the armature can pivot in the second plane;

a first guide that is rotatably coupled to an end of the armature to allow the first guide to swivel;

a second guide that is located on the armature;

a third guide that is orthogonal to the second guide; and a tether that extends through each of the first guide, the second guide, and the third guide, the tether being coupled with a load.

18. The exercise system according to claim 17, wherein the third plate comprises a first arcuate row of apertures and a third locking member, a position of the armature in the second plane being selected by placing the third locking member into at least one aperture of the first arcuate row of apertures.

19. The exercise system according to claim 18, wherein the translatable positioning assembly comprises rollers that engage with the frame member.

20. An exercise system comprising:

a vertical frame member having a plurality of apertures extending therethrough;

a handle assembly that is vertically adjustable along the vertical frame member by interfacing with one or more of the plurality of apertures;

a translatable positioning assembly including:

a first plate coupled to the handle assembly and a second plate coupled to the handle assembly, wherein the second plate is parallel to and spaced apart from the first plate, wherein the first plate and the second plate extend forward from the handle assembly beyond a forward face of the vertical frame member, wherein the first plate includes a plurality of first apertures and wherein the second plate includes a plurality of second apertures at least a portion of which correspond to the plurality of first apertures;

a connector pivotally coupled intermediate the first and second plates, wherein the connector is arcuately adjustable in a first plane relative to the vertical frame member;

a bracket secured to the connector, the bracket including an upper portion and a third plate, wherein the third plate is parallel to and spaced apart from the upper portion, wherein the bracket extends from the connector to a position forward of the first and second plates, and wherein the third plate includes a third plurality of apertures; and an armature pivotally coupled intermediate the upper portion and the third plate of the bracket, wherein the armature is arcuately adjustable in a second plane relative to the vertical frame member, and wherein the armature is arcuately adjustable in the first plane by being coupled to the connector via the bracket.

21. An exercise system comprising:

a translatable positioning assembly comprising a handle assembly having a trigger lock, the handle assembly being configured to engage with a frame member of a rack in such a way that the handle assembly can be selectively positioned along the frame member, the trigger lock being configured to engage with at least one aperture of a first plurality of apertures of the frame member when a desired position for the translatable positioning assembly is selected;

an armature that is pivotably coupled to the handle assembly in such a way that the armature can pivot in a first plane, the armature being configured to pivot in a second plane;

a weight post secured to an armature adapter by a connector, wherein the connector additionally engages at least one aperture of a plurality of apertures of the armature, the armature adapter being selectively positionable along the armature, the weight post configured to allow a user to attach a first load to the armature;

wherein the handle assembly comprises a first plate, a second plate, and a handle, the first plate and the second plate being spaced apart from one another so as to fit around the frame member;

a second locking member that is inserted through the first plate, the second plate, and the frame member;

a pivot coupling member comprising a bracket and a third plate, the bracket being coupled to the first plate and the second plate in such a way that the bracket can pivot in the first plane, the pivot coupling member connected to the armature;

wherein the third plate comprises a first arcuate row of apertures and a second lock, a position of the armature in the second plane being selected by placing the second lock into at least one aperture of the first arcuate row of apertures, the second lock being configured to lock in a retracted position to allow the armature to freely pivot in the second plane;

wherein the first plate comprises a second row of apertures and the second plate comprise a third row of apertures; and a third locking member that is placed through at least one aperture of the second row of apertures of the first plate and at least one aperture of the third row of apertures to select a position of the pivot coupling member in the first plane, the third locking member acting as a stop that the pivot coupling member rests upon.

* * * * *